US007380594B2

(12) United States Patent
Benzie et al.

(10) Patent No.: US 7,380,594 B2
(45) Date of Patent: Jun. 3, 2008

(54) METHOD OF INSTALLING A TUBULAR ASSEMBLY IN A WELLBORE

(75) Inventors: Scott Anthony Benzie, GD Rijswijk (NL); Martin Gerard Rene Bosma, GD Rijswijk (NL); Mikhail Boris Geilikman, GD Rijswijk (NL); Andrei Gregory Filippov, Katy, TX (US)

(73) Assignee: Shell Oil Company, Houston, TX (US)

( * ) Notice: Subject to any disclaimer, the term of this patent is extended or adjusted under 35 U.S.C. 154(b) by 310 days.

(21) Appl. No.: 10/536,207

(22) PCT Filed: Nov. 21, 2003

(86) PCT No.: PCT/EP03/50863

§ 371 (c)(1),
(2), (4) Date: May 24, 2005

(87) PCT Pub. No.: WO2004/048750

PCT Pub. Date: Jun. 10, 2004

(65) Prior Publication Data

US 2005/0279509 A1 Dec. 22, 2005

(30) Foreign Application Priority Data

Nov. 26, 2002 (EP) ..... 02258118

(51) Int. Cl.
*E21B 43/10* (2006.01)

(52) U.S. Cl. ..... 166/207; 166/285; 166/382

(58) Field of Classification Search ..... 166/206, 166/207, 382, 384, 285
See application file for complete search history.

(56) References Cited

U.S. PATENT DOCUMENTS

| | | | | |
|---|---|---|---|---|
| 4,462,429 | A | 7/1984 | Coursen | 137/891 |
| 2001/0045284 | A1 | 11/2001 | Simpson et al. | 166/313 |
| 2002/0185274 | A1 | 12/2002 | Simpson et al. | 166/277 |
| 2003/0146003 | A1 | 8/2003 | Duggan et al. | 166/384 |

FOREIGN PATENT DOCUMENTS

| | | |
|---|---|---|
| EP | 1044316 | 10/2000 |

(Continued)

OTHER PUBLICATIONS

International Search Report dated Jul. 6, 2004.

(Continued)

*Primary Examiner*—Giovanna C Wright

(57) ABSTRACT

A method of installing an expandable tubular assembly in a wellbore, the tubular assembly including a plurality of expandable tubular elements, comprising: installing a first tubular element in the wellbore; installing a second tubular element in the wellbore such that an end part of the second tubular element extends into an end part of the first tubular element, arranging a radially deformable body around the overlapping portion; and radially expanding the end part of the second tubular element against the end part of the first tubular element such that the end part of the first tubular element becomes radially expanded and the deformable body becomes radially deformed, wherein a body of cement is present between the first tubular element and the wellbore wall, and wherein the deformable body is a fluidic volume that is pumped between the first tubular element and the wellbore wall before hardening of the cement.

12 Claims, 5 Drawing Sheets

FOREIGN PATENT DOCUMENTS

| | | |
|---|---|---|
| WO | 99/35368 | 7/1999 |
| WO | 01/02832 | 1/2001 |
| WO | WO0118354 A1 | 3/2001 |
| WO | 02/25056 | 3/2002 |
| WO | 02/053867 | 7/2002 |
| WO | 02/073000 | 9/2002 |
| WO | 02/086285 | 10/2002 |
| WO | 02/086286 | 10/2002 |
| WO | 03/006788 | 1/2003 |

OTHER PUBLICATIONS

European Search Report dated May 22, 2003.

METHOD OF INSTALLING A TUBULAR ASSEMBLY IN A WELLBORE

CROSS-REFERENCE TO RELATED APPLICATIONS

This case claims priority to PCT/EP03/50863, filed Nov. 21, 2003, which is incorporated herein by reference.

STATEMENT OF FEDERALLY SPONSORED RESEARCH

Not applicatable.

FIELD OF THE INVENTION

The present invention relates to a method of installing a tubular assembly in a wellbore formed in an earth formation, which tubular assembly includes a plurality of expandable tubular elements. The tubular elements can be, for example, wellbore casing sections or wellbore liners.

BACKGROUND OF THE INVENTION

In conventional methods of wellbore drilling, tubular casing is installed in the wellbore at selected depth intervals. Each new casing to be installed must pass through the previously installed casing, therefore the new casing must be of smaller diameter than the previously installed casing. As a result of such procedure, the available internal diameter of the wellbore for fluid production becomes smaller with depth. For very deep wells, or for wells in which casing is to be installed at relatively short intervals, such conventional casing scheme may render the well uneconomical. In view thereof it has been proposed to radially expand casing/liner sections after installation at the desired depth.

EP-A-1044316 discloses a method whereby a first tubular element is installed in the wellbore, and a second tubular element is installed in the wellbore so that an upper part of the second tubular element extends into a lower part of the first tubular element so as to form an overlapping portion of the tubular elements. The upper part of the second tubular element is then radially expanded against the first tubular element such that as a result thereof said lower part of the first tubular element is radially expanded.

A drawback of the known method is that the expansion forces needed to expand the lower part of the first tubular element generally are extremely high.

It is therefore an object of the invention to provide an improved method of installing a tubular assembly in a wellbore, which overcomes the drawback of the known method.

SUMMARY OF THE INVENTION

In accordance with the invention there is provided a method of installing a tubular assembly in a wellbore formed in an earth formation, the tubular assembly including a plurality of expandable tubular elements, the method comprising:

installing a first tubular element in the wellbore;

installing a second tubular element in the wellbore in a manner that an end part of the second tubular element extends into an end part of the first tubular element thereby forming an overlap portion of the tubular assembly, said overlap portion being positioned in the wellbore such that a radially deformable body is arranged around the overlap portion; and radially expanding the end part of the second tubular element against the end part of the first tubular element in a manner that the end part of the first tubular element becomes radially expanded and said deformable body becomes radially deformed.

It is thereby achieved that the expansion forces are reduced since the force needed to expand the overlap portion remains within acceptable limits due to the first tubular element being expanded against the radially deformable body, instead of being expanded against a layer of hardened cement as in the prior art.

Suitably the second tubular element extends below the first tubular element, and wherein an upper end part of the second tubular element extends into a lower end part of the first tubular element.

In a preferred embodiment the deformable body includes at least one of a compressible portion of the earth formation and a deformable volume arranged in an annular space formed between the tubular assembly and the wellbore wall.

It is further preferred that the deformable volume includes at least one of a fluidic volume, an elastomer volume, a foam cement volume, and a porous material volume.

Such deformable volume suitably includes a fluidic volume including at least one of a liquid, a gas, a gel, and a non-hardening fluid selected from a Bingham fluid, a Herschel-Bulkley fluid, a fluid having anti-thixotropic characteristics, and a fluidic system having a finite yield strength at zero shear-rate.

Another aspect of the invention relates to a system for initiating radial expansion of a tubular element in a wellbore, comprising an expander for expanding the tubular element, an actuator for pulling the expander through the tubular element, and an anchor for anchoring the actuator to the tubular element.

BRIEF DESCRIPTION OF THE DRAWINGS

The invention will be described hereinafter in more detail by way of example, with reference to the accompanying drawings in which:

In the Figures, like reference numerals relate to like components.

FIGS. 1A-C show a first expandable tubular element in the form of a casing 2 arranged in a wellbore 4 formed in an earth formation 6.

DETAILED DESCRIPTION OF THE PREFERRED EMBODIMENTS

Figure 1A:
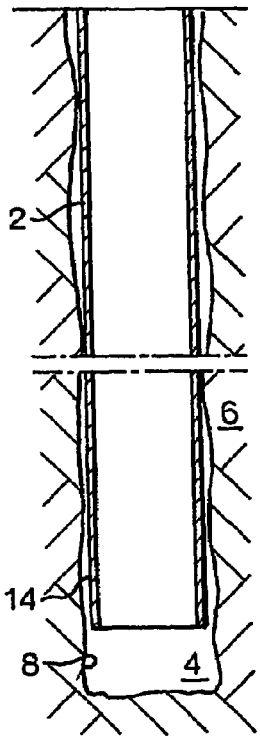
FIGS. 1A-C schematically show subsequent stages during installation of a tubular wellbore assembly according to a first embodiment of the method of the invention.

Referring to FIG. 1A, the casing 2 is lowered into the wellbore 4 in unexpanded state and subsequently radially expanded against the wellbore wall 8. Since the wellbore wall 8 can have a somewhat irregular shape, the expanded casing 2 may not be entirely in contact with the wellbore wall 8. The earth formation 6 is somewhat compressible so that as a result of expansion of the casing 2 against the wellbore wall 8, the casing 2 is in sealing relationship with the wellbore wall 8 at the points of contact.

Figure 1B:
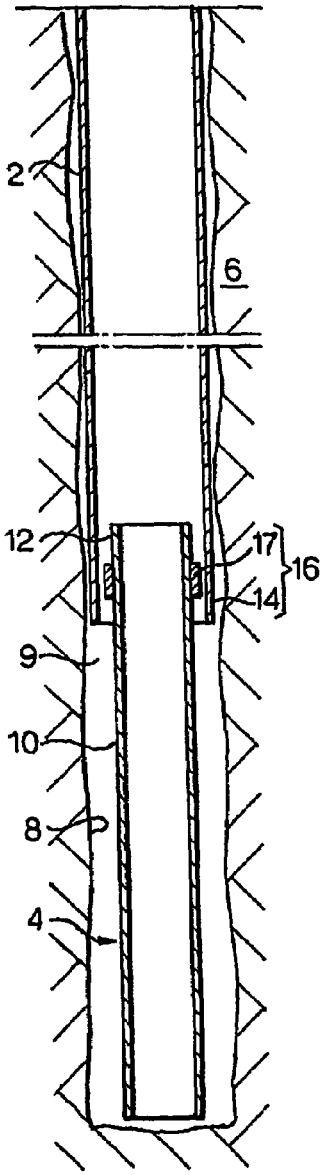

Referring to FIG. 1B, a further wellbore section 9 is drilled and a second expandable tubular element in the form of liner 10 is lowered through the casing 2. The liner 10 is positioned in the wellbore 4 such that an upper part 12 of the liner 10 extends into a lower part 14 of the casing 2 thereby defining an overlap portion 16 of casing 2 and liner 10. An elastomer seal ring 17 extends around the upper end part 12 of liner 10.

Figure 1C:
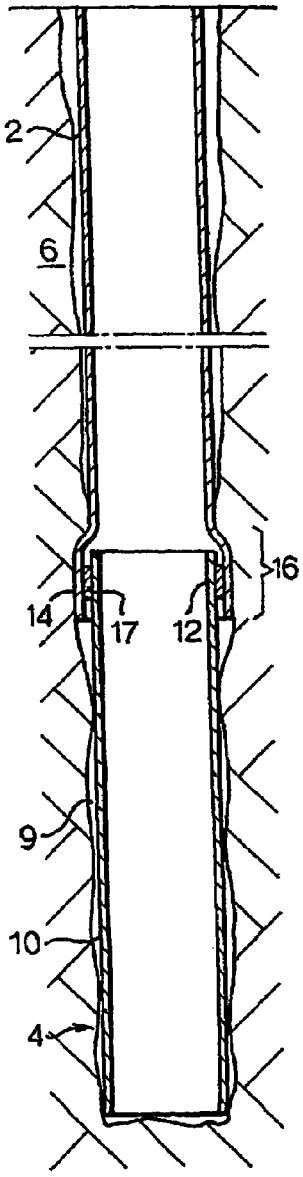

Referring to FIG. 1C, the liner 10 is radially expanded against the wellbore wall 8 whereby the upper part 12 of liner 10 is expanded against the lower part 14 of casing 2. After the expansion process, the inner diameter of the liner 10 is substantially equal to the inner diameter of expanded casing 2. As a result, the lower part 14 of casing 2 is expanded further against the earth formation 6 which thereby becomes (further) compressed. The seal ring 17 seals the liner 10 to the casing 2.

In this manner it is achieved that an expanded tubular assembly of casing 2 and liner 10 is installed in the wellbore, whereby zonal isolation is obtained by expansion of casing 2 and liner 10 against the wellbore wall 8. It is to be understood that "zonal isolation" means that migration of wellbore fluids (such as high pressure hydrocarbon fluid from the earth formation) through a flow path between the tubular assembly and the wellbore wall 8 is prevented.

FIGS. 2A-D show another embodiment whereby a radially expanded casing 2 extends into wellbore 4.

Figure 2A:
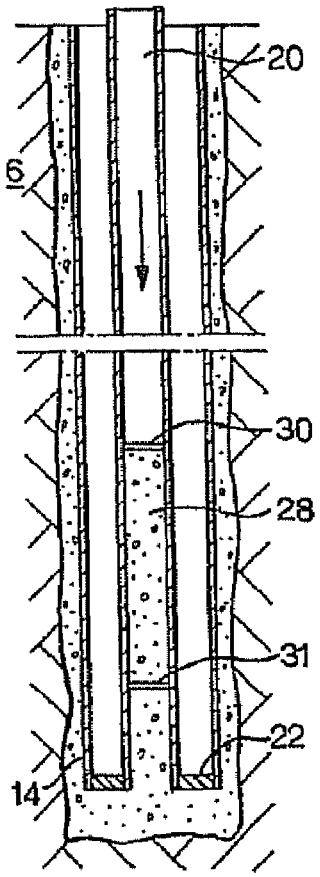
FIGS. 2A-D schematically show subsequent stages during installation of a tubular wellbore assembly according to a second embodiment of the method of the invention.
Figure 2B:
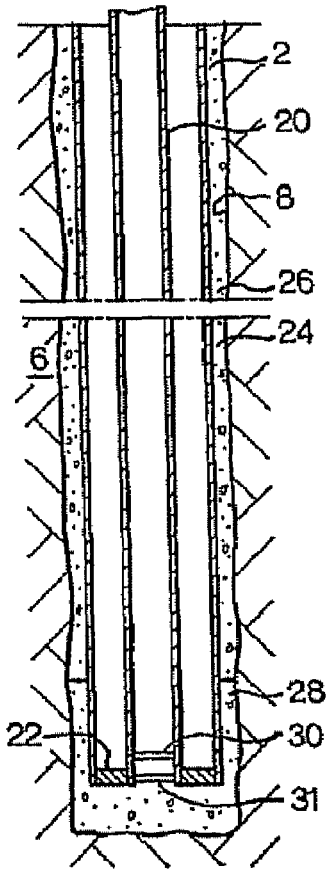

Referring to FIGS. 2A, 2B, a conduit 20 extends trough the casing 2 and passes through a bottom closure in the form of float shoe 22 arranged at the lower end of the casing 2. A volume of cement 24 is pumped via the conduit 20 into the lower part of the wellbore 4, and from there into the annular space 26 formed between the casing 2 and the wellbore wall 8. A batch of non-hardening fluidic material in the form of gel 28 is contained between a pair of wiper plugs 30, 31. The batch of gel 28 is pumped behind the cement volume 24 via the conduit 20 into the annular space 26. The amount of gel is sufficient to fill a portion of the annular space 26 located around the lower part 14 of the casing 2. Furthermore, the gel 28 has a higher specific density than the cement 24. The lower wiper plug 31 is designed to rupture once it is stopped from being pumped through the conduit 20 by a suitable stop shoulder (not shown) arranged at the lower end of the conduit 20. Preferably, the gel has a relatively high yield strength. For example a gel can be used which is a Bingham Plastic, a Herschel-Bulkley fluid, or any other fluid having a finite yield stress at zero shear rate. In this respect reference can be made for example to: R. W. Whorlow, "Rheological Techniques, Ellis Horwood Ltd, 2nd ed. (1972), ISBN 0-13-77537005, pages 12-18. Also, a gel having a reversible time-dependent increase in viscosity (generally known as negative thixotropy or anti-thixotropy; reference pages 20-23 of the indicate textbook) can be used.

After rupture of the wiper plug 31 upon being pumped against the stop shoulder, the entire batch of gel 28 is pumped into the portion of annular space 26 around the lower part 14 of casing 2 (FIG. 2B). The volume of gel 28 remains below the volume of cement 24 in the annular space 26 by virtue of the density difference between the gel and the cement. Furthermore, the gel does not migrate into the cement layer during the pumping process due to its high yield strength.

Figure 2C:
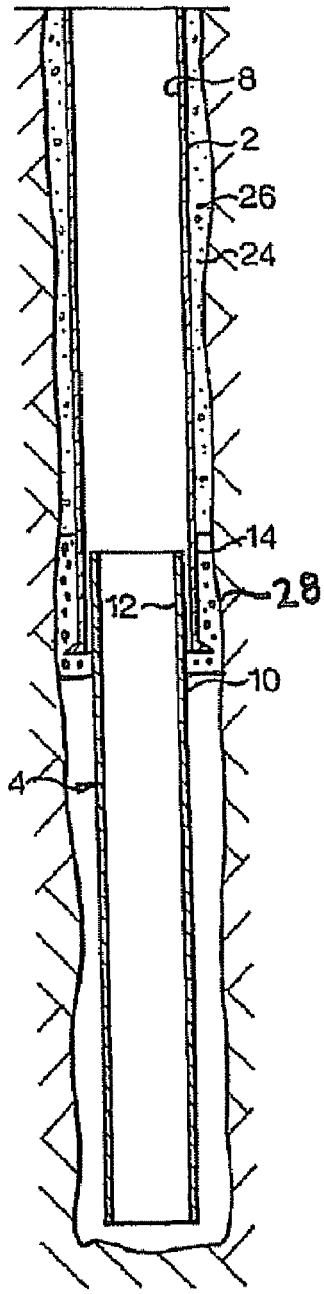

Referring to FIG. 2C, in a next step the conduit 20 is removed from the wellbore 4 and the wellbore 4 is deepened after hardening of the cement 24 in annular space 26. The portion of annular space 26 around the lower part 14 of casing 2 has not been cemented because of the presence of the gel in said portion. Expandable liner 10 is then lowered into the wellbore 4 through the casing 2 until the liner is near the bottom of the wellbore 4, whereby the upper part 12 of liner 10 extends into the lower part 14 of casing 2 so that an overlap portion 16 of casing 2 and liner 10 is defined.

Figure 2D:
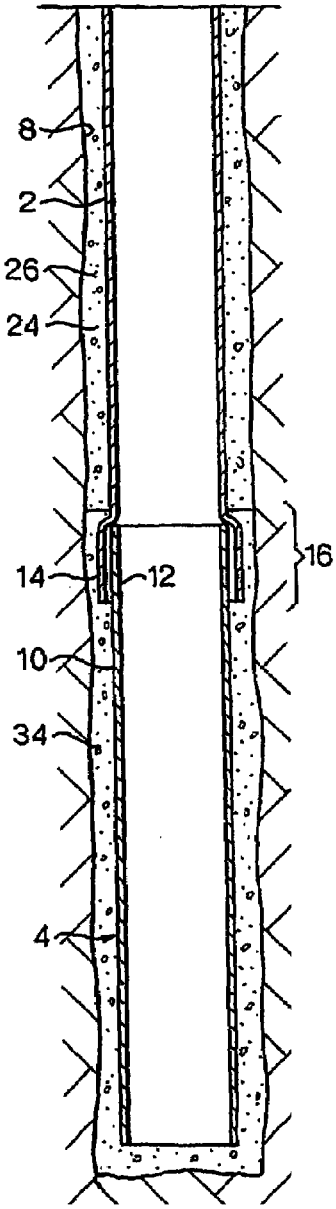

Referring to FIG. 2D, in a further step the liner 10 is radially expanded whereby the upper part 12 of liner 10 is expanded against the lower part 14 of casing 2. The expansion of liner 10 is such that its inner diameter becomes substantially equal to the inner diameter of expanded casing 2. As a result thereof the lower part 14 of casing 2 is expanded further. Such expansion of the lower part 14 of casing 2 is feasible by virtue of the absence of cement in the annular space 26 at the overlap portion 16 of casing 2 and liner 10. The expanded liner 10 is subsequently cemented in the wellbore by a layer of cement 34.

Figure 3A:
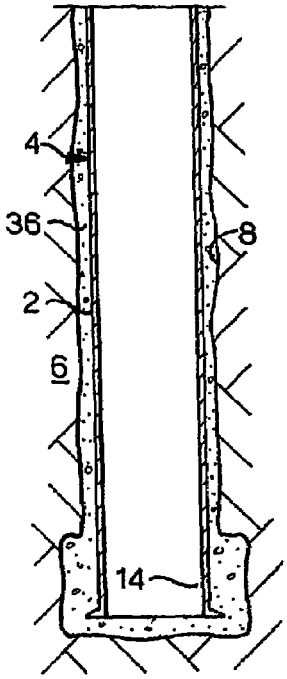
FIGS. 3A-C schematically show subsequent stages during installation of a tubular wellbore assembly according to a third embodiment of the method of the invention.
Figure 3B:
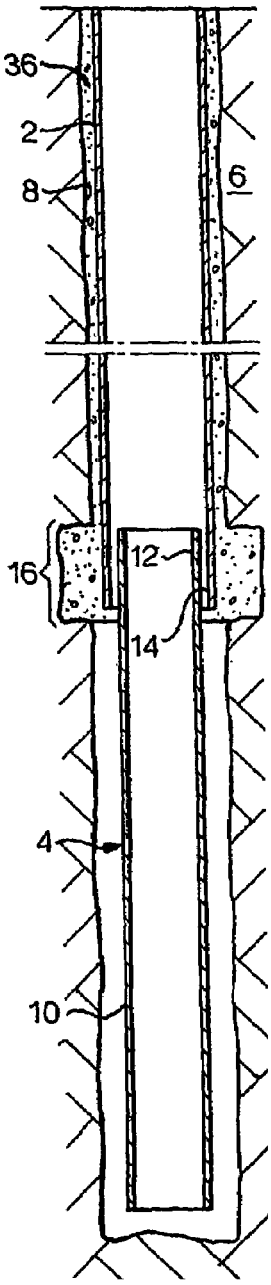
Figure 3C:
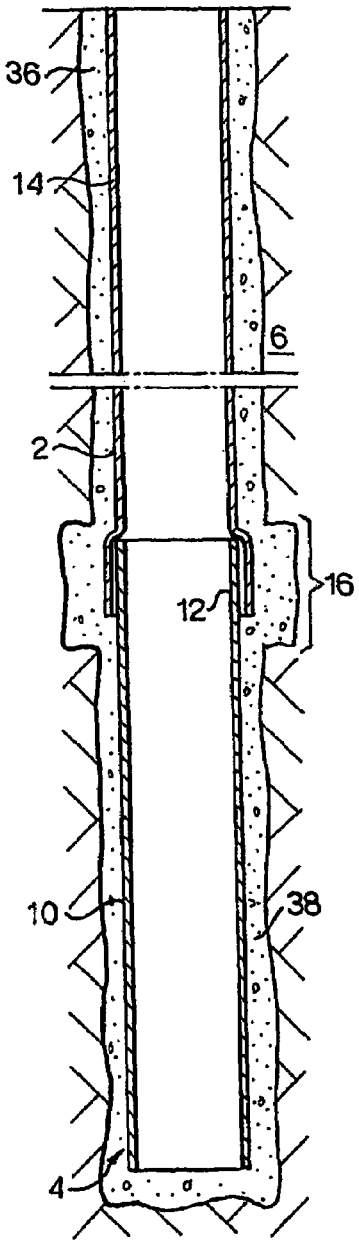

In FIGS. 3A-C is shown a further embodiment whereby the casing 2 is radially expanded in the wellbore 4.

Referring to FIG. 3A, a lower part of the wellbore 4 has been under-reamed so as to enlarge its diameter prior to installation of the casing 2 in the wellbore 4. A layer of foam cement 36 is pumped into the annular space 26 around casing 2.

Referring to FIG. 3B, a further section of the wellbore 4 is then drilled and expandable liner 10 is installed into the wellbore 4 through the casing 2 until the liner 10 is near the bottom of the wellbore 4. In this position the upper part 12 of the liner 10 extends into the lower part 14 of the casing 2, thus defining overlap portion 16 of casing 2 and liner 10.

Referring to FIG. 3C, the liner 10 is then radially expanded to substantially the same inner diameter as the expanded casing 2 so that as a result thereof the lower part 14 of casing 2 becomes expanded further. Such further expansion of the lower part 14 of casing 2 is feasible by virtue of the compressibility of the foam cement (due to elastic and/or plastic deformation) surrounding the overlap portion 16. The expanded liner 10 is subsequently cemented in the wellbore by a layer of foam cement 38.

Figure 4A:
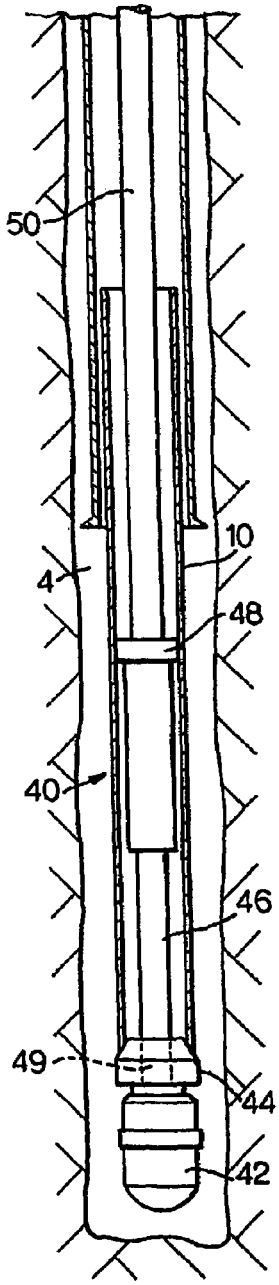
FIGS. 4A-C schematically show an example of an expander tool used in the method of the invention, during subsequent stages of the expansion process.
Figure 4B:
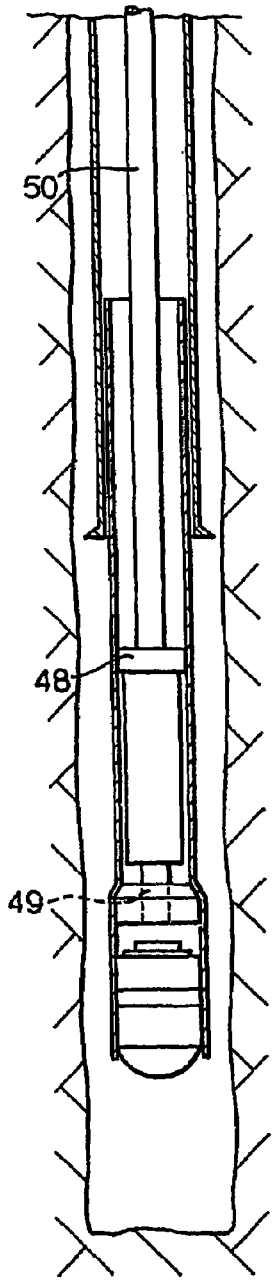
Figure 4C:
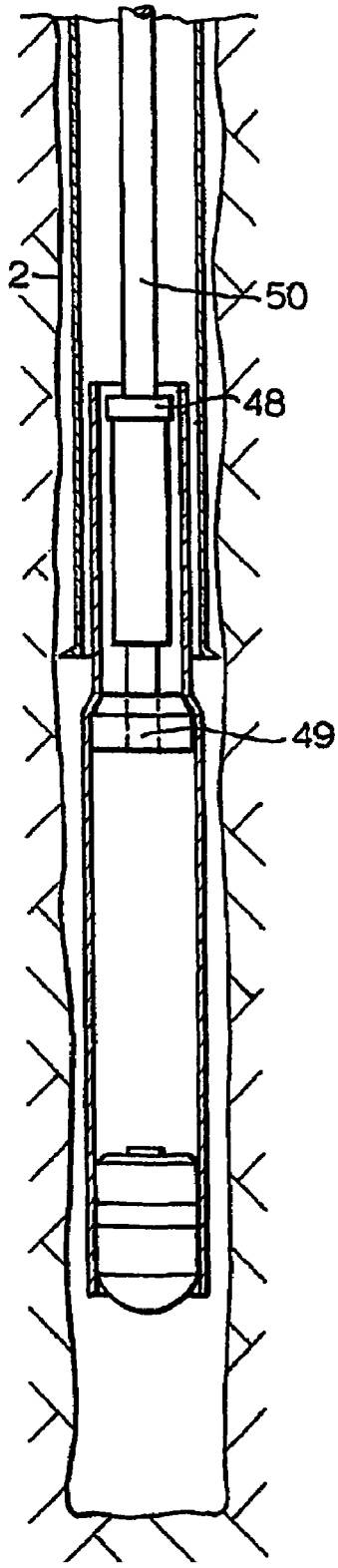

Reference is now made to FIGS. 4A-C showing an example expander tool 40 for application in the method of the invention. The expander tool 40 includes an expandable bottom plug 42 for plugging the lower end of the expanded liner 10, an expander cone 44 for expanding the liner 10, a hydraulic actuator 46 (also referred to as "force multiplier") capable of pulling the expander cone 44 into the liner 10, and an expandable anchor 48 for anchoring the upper end of hydraulic actuator 46 to the liner 10. The expander cone 44 has a through-bore 49 which is in fluid communication with a pump (not shown) at surface via a fluid passage (not shown) passing through hydraulic actuator 46, anchor 48 and a tube string 50 which extends from the anchor 48 to the pump at surface.

During normal use the expander tool 40 is initially suspended by tube string 50 in a position whereby the expander cone 44 is located below the liner 10 (FIG. 4A). Next the anchor 48 is expanded against the inner surface of liner 10 so as to become anchored thereto, and the hydraulic actuator is operated to pull the expander cone 44 and the bottom plug 42 into the lower end part of the liner 10 whereby said lower end part becomes radially expanded (FIG. 4B). Subsequently the bottom plug 42 is fixedly set in the lower end part of the liner 10, the expander cone 44 is released from the bottom plug 42, and fluid at high pressure is pumped from surface via the tube string 50 into the liner 10. As a result the expander cone 44 is pumped upwardly through the liner 10 which is thereby radially expanded (FIG. 4C). The tube string 50 is lifted from surface in synchronization with upward movement of the expander cone 44.

The invention claimed is:

1. A method of installing an expandable tubular assembly in a wellbore formed in an earth formation, the tubular assembly including a plurality of expandable tubular elements, the method comprising:

installing a first tubular element in the wellbore;

installing a second tubular element in the wellbore in a manner that an end part of the second tubular element extends into an end part of the first tubular element thereby forming an overlap portion of the tubular assembly, said overlap portion being positioned in the wellbore such that a radially deformable body is arranged around the overlap portion; and radially expanding the end part of the second tubular element against the end part of the first tubular element in a manner that the end part of the first tubular element becomes radially expanded and said deformable body becomes radially deformed, wherein a body of cement is present between the first tubular element and the wellbore wall, characterized in that the deformable body is a fluidic volume which is pumped between the first tubular element and the wellbore wall before hardening of the cement.

2. The method of claim 1, wherein the second tubular element extends below the first tubular element, and wherein an upper end part of the second tubular element extends into a lower end part of the first tubular element.

3. The method of claim 1, wherein the fluidic volume is arranged in an annular space formed between the tubular assembly and the wellbore wall.

4. The method of claim 1, wherein the fluidic volume includes at least one of a liquid, a gas, a gel, and a non-hardening fluid selected from a Bingham fluid, a Herschel-Bulkley fluid and a fluid having antithixotropic characteristics.

5. The method of claim 4, wherein the fluidic volume includes a non-hardening fluid, and wherein the method further comprises pumping the non-hardening fluidic volume into a portion of said annular space surrounding the overlap portion.

6. The method of claim 5, further comprising pumping a hardening fluidic volume into a remaining portion of said annular space so as to fix the tubular assembly in the wellbore.

7. The method of claim 6, wherein the non-hardening fluidic volume is pumped into the wellbore in the form of a batch which is pumped after pumping said volume of cement into the annular space.

8. The method of claim 7, wherein said batch is pumped into the wellbore through a conduit extending into the wellbore, and wherein the batch is positioned between a pair of plug members located in the conduit.

9. The method of claim 8, wherein each plug member is a wiper plug or a dart.

10. The method of claim 9, wherein the hardening fluid has a lower specific weight than the non-hardening fluid.

11. The method of claim 1, wherein the deformable volume includes a foam cement volume, the method further comprising pumping the foam cement volume into a portion of the annular space located around said overlap portion of the tubular assembly.

12. The method of claim 1 wherein the second tubular element is provided with at least one elastomer seal arranged between the first tubular element and the second tubular element so as to seal the first tubular element to the second tubular element.

* * * * *